US008414354B2

(12) United States Patent
Pei

(10) Patent No.: US 8,414,354 B2
(45) Date of Patent: Apr. 9, 2013

(54) GLASS MANUFACTURING DEVICE

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 358 days.

(21) Appl. No.: 12/894,092

(22) Filed: Sep. 29, 2010

(65) Prior Publication Data

US 2012/0015591 A1 Jan. 19, 2012

(30) Foreign Application Priority Data

Jul. 14, 2010 (TW) ..... 99123161

(51) Int. Cl.
*B24C 3/00* (2006.01)

(52) U.S. Cl.
USPC ..... 451/2; 451/9; 451/10; 451/11; 451/29; 451/89; 451/102

(58) Field of Classification Search ..... 451/2, 9, 451/10, 11, 29, 75, 89, 102
See application file for complete search history.

(56) References Cited

U.S. PATENT DOCUMENTS

| | | | | |
|---|---|---|---|---|
| 5,052,155 | A * | 10/1991 | Blacka et al. | 451/78 |
| 5,195,279 | A * | 3/1993 | Wern | 451/2 |
| 5,490,807 | A * | 2/1996 | Marchell | 451/3 |
| 6,422,920 | B1 * | 7/2002 | Bouten et al. | 451/29 |
| 7,121,925 | B2 * | 10/2006 | Hashimura et al. | 451/29 |
| 7,586,047 | B2 * | 9/2009 | Hayashi et al. | 174/266 |
| RE42,405 | E * | 5/2011 | Fujinaga et al. | 313/582 |
| 2003/0008598 | A1 * | 1/2003 | Jimbo et al. | 451/38 |
| 2003/0121511 | A1 * | 7/2003 | Hashimura et al. | 125/2 |
| 2006/0137173 | A1 * | 6/2006 | Dunn et al. | 29/600 |
| 2011/0126876 | A1 * | 6/2011 | Guo et al. | 136/244 |

* cited by examiner

*Primary Examiner* — Eileen P. Morgan
(74) *Attorney, Agent, or Firm* — Altis Law Group, Inc.

(57) ABSTRACT

A glass manufacturing device includes a working container, a loading device, a sand blower, a shielding device, and a supporting device. The loading device is received in the working container and configured for loading a glass substrate in place. The sand blower is arranged opposite to the loading device and configured for sandblasting the glass substrate. The supporting device is used for supporting the shielding device and pressing the shielding device onto the glass substrate during the process of sandblasting. The shielding device includes a shielding cover having a number of shielding units. The shielding units are configured to shield portions of the glass substrate and prevent the portions of the glass substrate from being cut during sandblasting.

10 Claims, 4 Drawing Sheets

GLASS MANUFACTURING DEVICE

BACKGROUND

1. Technical Field

The present disclosure relates to glass manufacturing device.

2. Description of Related Art

Currently, methods for manufacturing glass workpieces often include the following steps: cutting a glass substrate into a number of preforms having the same size and shape; gluing the preforms in position using ultraviolet (UV) glue; grinding edges of the preforms to obtain the workpieces; then removing the UV glue to separate the workpieces, which is complicated and time-consuming.

Therefore, it is desirable to provide a glass manufacturing device that can overcome the above-mentioned limitations.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
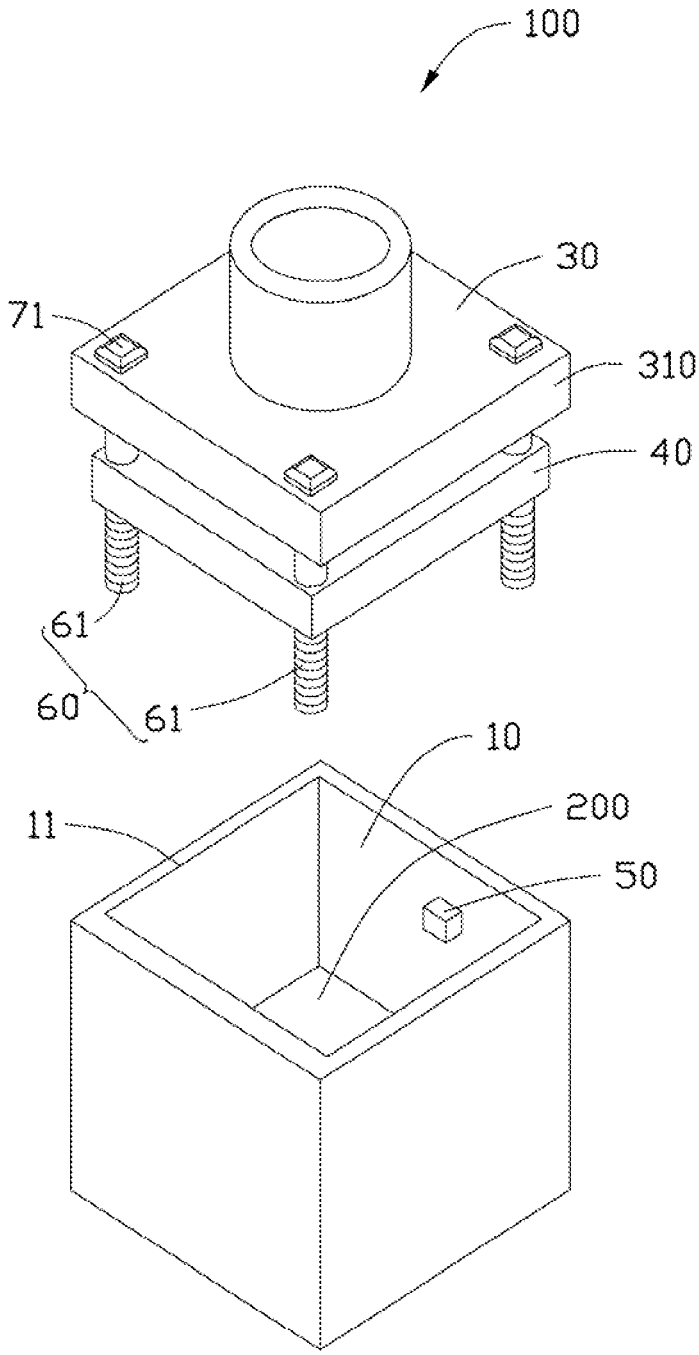
FIG. 1 is an exploded view of glass manufacturing device, according to an exemplary embodiment.
Figure 2:
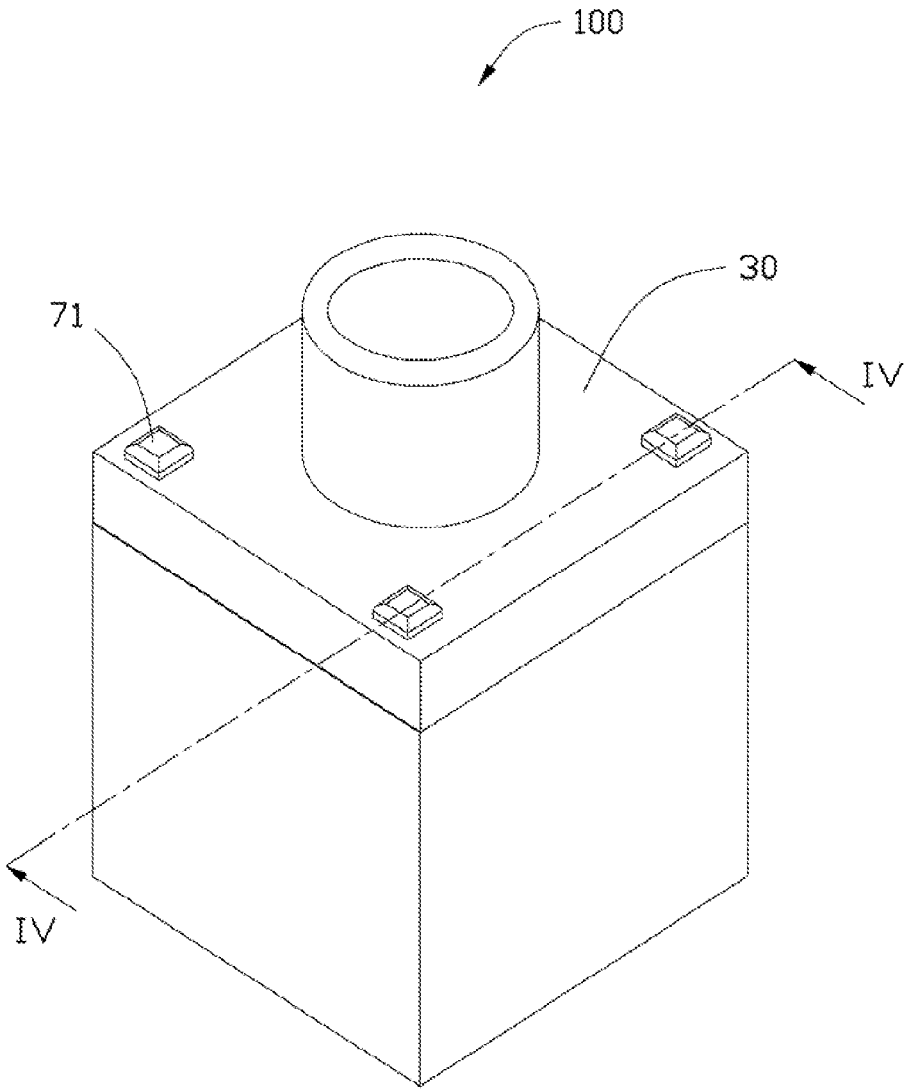
FIG. 2 is a schematic view of the glass manufacturing device of FIG. 1.
Figure 3:
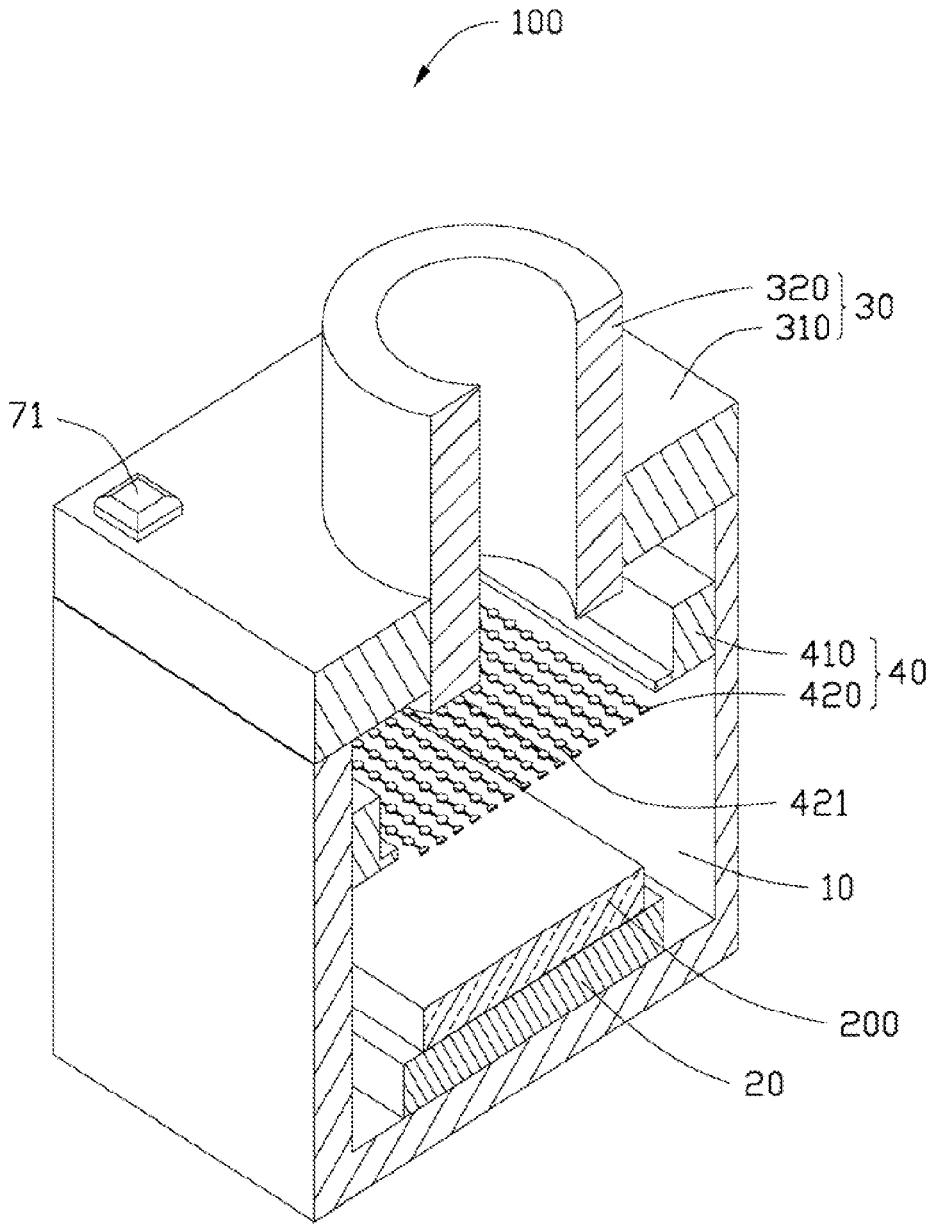
FIG. 3 is a cross-sectional view of the glass manufacturing device of FIG. 1.

Referring to FIGS. 1-3, a glass manufacturing device 100, according to an exemplary embodiment, includes a working container 10, a loading device 20, a sand blower 30, a shielding device 40, a temperature adjusting device 50, a supporting device 60, and a lift controlling device 70.

The working container 10 is substantially cubic and defines one rectangular opening 11 for receiving the loading device 20, the shielding device 40, the temperature adjusting device 50, and the supporting device 60 therein.

The loading device 20 is arranged on the bottom of the working container 10 and used for supporting a glass substrate 200 in place. In this embodiment, the glass substrate 200 is rectangular. In other embodiments, the glass substrate 200 can be other shapes (e.g. circular or triangular).

The sand blower 30 includes a fixing plate 310 and a jet 320. The fixing plate 310 is used for hermetically sealing the opening 11. The jet 320 perpendicularly extends through the top and bottom surfaces of the fixing plate 310 and into the working container 10. The jet 320 can sandblast the glass substrate 200 to cut the glass substrate 200 into a number of glass products. In this embodiment, the fixing plate 310 is rectangular, corresponding to the shape of the opening 11.

The shielding device 40 is received in the opening 11, arranged between the fixing plate 310 and the loading device 20, and is substantially parallel to the fixing plate 310. The shielding device 40 includes a fixing frame 410 and a shielding cover 420 fixed on the fixing frame 410. The area of the fixing frame 410 is slightly smaller than that of the opening 11, and thus the shielding cover 420 can be fittingly inserted into the working container 10, and abutted against the inner sidewall of the working container 10. The shielding cover 420 is made of rigid metal (e.g. iron), and thus is resistant to the effects of the sandblasting and so will last a long time through many uses. Therefore, the shielding cover 420 can shield the glass substrate 200, while it is quickly cut by the sandblasting in predetermined patterns. The shielding cover 420 includes a number of shielding units 421. In this embodiment, the shielding units 421 are arranged in an array. Each shielding unit 421 is circular. In other embodiments, the shielding units 421 can be arranged in other manners and be some other shape, according to user's need.

The surface of each shielding unit 421 facing the bottom of the working container 10 is coated with a layer of silica gel. The silica gel is in a semi-solid state and not easy to break away from the shielding unit 421. The silica gel can have the following characteristics: when the silica gel is heated to 80° C.~120° C., it will be fluidized and its stickiness will be strengthened; when the silica gel is cooled to −40° C., its stickiness will be destroyed. Therefore, the stickiness of the silica gel is reinforced, and the shielding units 421 are firmly glued to the glass substrate 200 to prevent sand penetrating to portions of the glass substrate 200 shielded by the shielding units 421 to ensure that the glass substrate 200 is precisely cut in the predetermined pattern. When the stickiness of the silica gel is destroyed by being cooled to −40° C., the shielding units 421 are easily separated from the glass substrate 200. In other embodiments, other glues having the same characteristics as the silica gel can be employed instead.

The temperature adjusting device 50 is arranged on an inner sidewall of the working container 10 and adjacent to the opening 11. The temperature adjusting device 50 is used for adjusting the temperature of the shielding units 421. In this embodiment, the temperature adjusting device 50 is an air heating and cooling device which can raise or lower the temperature of the working container 10 quickly. In other embodiments, the temperature adjusting device 50 also can be adhered to the shielding units 421.

Figure 4:
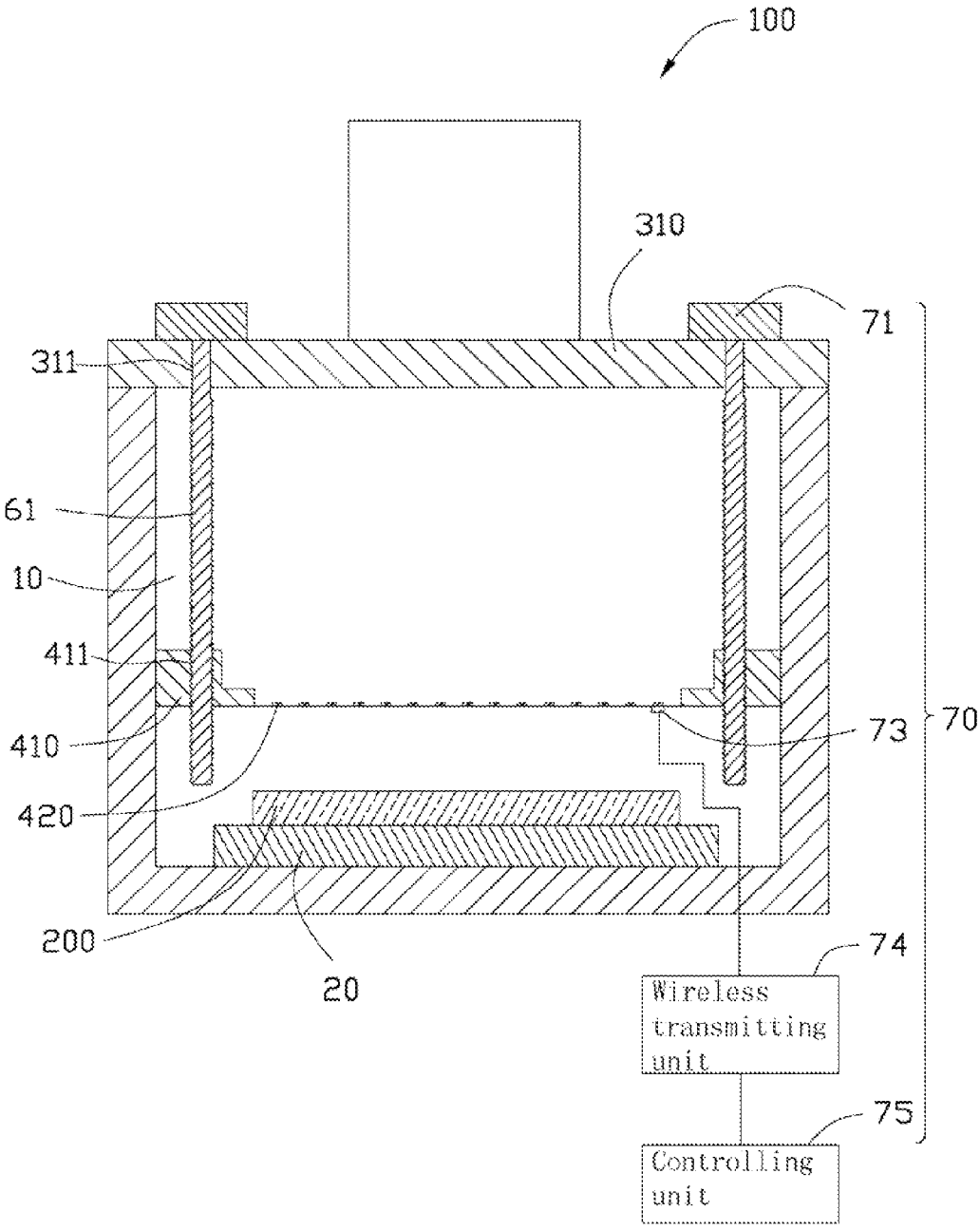
FIG. 4 is another cross-sectional view of the glass manufacturing device, taken along a line IV-IV of FIG. 2.

Referring to FIG. 4, the supporting device 60 includes four supporting poles 61 positioned at four corners of the fixing plate 310. The supporting device 60 is used for supporting the shielding cover 420 and pressing the shielding cover 420 on the glass substrate 200 during the process of sandblasting.

The lift controlling device 70 includes four elevator motors 71, a pressure sensor 73, a wireless transmitting unit 74, and a controlling unit 75. The fixing plate 310 defines four first though-holes 311. One end of each supporting pole 61 is extended through a corresponding first through-hole 311 and coupled to a rotor of the corresponding elevator motor 71, therefore, each elevator motor 71 can drive the corresponding supporting pole 61 to rotate. The other end of each supporting pole 61 is threaded. The fixing frame 410 defines four second threaded through-holes 411 for the threaded ends of the poles 61 threadedly engaging therein, thus the fixing frame 410 can be moved upwards or downwards along a direction perpendicular to the loading device 20. The pressure sensor 73 is used for sensing a pressure applied by the shielding unit 421 to the glass substrate 200 and converting the pressure to electrical signals. In this embodiment, the pressure sensor 73 is a piezoelectric sensor, and glued on the surface of one shielding unit 421 facing the loading device 20 using the silica gel. The wireless transmitting unit 74 is used for transmitting electrical signals between the pressure sensor 73 and the controlling unit 75. In this embodiment, the wireless transmitting unit 74 is a BLUETOOTH transmitting unit or a Wi-Fi transmitting unit. The controlling unit 75 is used for receiving the electrical signals from the pressure sensor 73, converting the electrical signals to a pressure value. The controlling unit 75 stores a predetermined value and is used for comparing the pressure value with the predetermined value, and is used for controlling the elevator motors 71 to rotate according to the comparison result. When the pressure value reaches the predetermined value, the controlling unit 75 controls the elevator motor 71 to stop working and the fixing frame 410 stops moving downwards to prevent damage to the glass substrate 200. Therefore, the lift controlling device 70 can control a lifting height of the shielding device 40 according to the thickness of the glass substrate 200. In this embodiment, the predetermined value is 0.5 kilograms/meters squared ($kg/m^2$). In other embodiments, the four supporting poles 61 also can be fixed on other locations of the fixing plate 310. The number of the supporting poles 61 is not limited to this embodiment.

In other embodiments, if a user only wants to manufacture the glass substrate 200 having the same thickness, the lift controlling device can be omitted. The two ends of each supporting pole 61 can be respectively fixed onto the fixing frame 410 and the fixing plate 310 to press the shielding units 421 on the glass substrate 200.

In use, the glass substrate 200 is fixed onto the loading device 20. A layer of silica gel is coated on the surface of the shielding unit 421 facing the bottom of the working container 10. The fixing plate 310 hermetically seals the opening 11. The temperature adjusting device 50 adjusts the temperature of the working container 10 to 80° C.~120° C. The elevator motors 71 respectively drive the corresponding supporting poles 61, so as to make the shielding units 421 move downwards to press onto the glass substrate 20 firmly through the engagement of the supporting poles 61 with the second threaded through holes 411. The blasting blower 30 blasts sand from the jet 320 onto the glass substrate 200 until the portions of the glass substrate 200 not shielded by the shielding units 421 are cut by the sand. Then the temperature adjusting device 50 adjusts the temperature of the working container 10 to −40° C. The stickiness of the silica gel is destroyed. The shielding units 421 separate from the glass substrate 200. The elevator motors 71 respectively drive the corresponding supporting poles 61 to move upwards. The remaining portions of the glass substrate 200 which were shielded by the shielding units 421 can then be used. The area of each piece of glass is equal to the corresponding shielding unit 421. It can be understood that the area of the shielding units 421 can be adjusted according to need.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A glass manufacturing device, comprising:

a working container having an opening;

a loading device received in the working container and configured for supporting a glass substrate;

a sand blower covering the opening and opposite to the loading device, the sand blower configured for sandblasting the glass substrate, the sand blower comprising a fixing plate and a jet, wherein the fixing plate defines at least one first though-hole, the jet perpendicularly extends through a top surface and a bottom surface of the fixing plate and communicates with the working container, the jet is configured to blast sands onto the glass substrate to cut the glass substrate;

a shielding device received in the working container and movably arranged between the loading device and the sand blower, the shielding device comprising a shielding cover having a plurality of shielding units and a fixing frame for fixing the shielding cover, the shielding units configured for shielding portions of the glass substrate and preventing the portions of the glass substrate from being cut during the process of sandblasting, the area of the fixing frame being slightly smaller than the area of the opening, and thus the fixing frame being received in the working container, and touching an inner sidewall of the working container, wherein the fixing frame defines at least one second threaded through-hole;

a supporting device received in the working container and configured for supporting the shielding device and pressing the shielding device on the glass substrate during the process of sandblasting, wherein the supporting device comprises at least one supporting pole; and a lift controlling device configured for controlling the supporting device to carry the shielding device to move relative to the loading device, the lift controlling device comprising at least one elevator motor, wherein one end of at least one supporting pole inserts through the at least one first through-hole and couples to the at least one elevator motor, the other end of the at least one supporting pole is threaded and engages with the at least one second threaded through-hole.

2. The glass manufacturing device of claim 1, wherein the lift controlling device comprises a pressure sensor, a wireless transmitting unit, and a controlling unit; the pressure sensor is configured for sensing a pressure applied by the shielding unit to the glass substrate and converting the pressure to an electrical signal; the wireless transmitting unit is configured for transmitting the electrical signal to the controlling unit; the controlling unit is configured for converting the electrical signal to a pressure value, and then comparing the pressure value with a predetermined value, and controlling the at least one elevator motor according to a comparison result.

3. The glass manufacturing device of claim 2, wherein the pressure sensor is a piezoelectric sensor, positioned on one shielding unit and faces the loading device.

4. The glass manufacturing device of claim 2, wherein the wireless transmitting unit is selected from the group consisting of a BLUETOOTH transmitting unit and a Wi-Fi transmitting unit.

5. The glass manufacturing device of claim 2, wherein the predetermined value is 0.5 $kg/m^2$.

6. The glass manufacturing device of claim 1, wherein the shielding cover is made of rigid metal.

7. The glass manufacturing device of claim 1, wherein the shielding units is arranged in an array.

8. The glass manufacturing device of claim 1, wherein the surfaces of the shielding units facing to the bottom of the working container are coated with glue.

9. The glass manufacturing device of claim 8, wherein the glue is a silica gel in a semi-solid state.

10. The glass manufacturing device of claim 1, further comprising a temperature device configured for adjusting the temperature of the shielding units.

* * * * *